US007559677B1

(12) United States Patent
Dupre

(10) Patent No.: US 7,559,677 B1
(45) Date of Patent: Jul. 14, 2009

(54) RECESSED LUMINAIRE ADJUSTMENT MECHANISM

(75) Inventor: Scott Dupre, Fall River, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 11/865,006

(22) Filed: Sep. 30, 2007

(51) Int. Cl.
*F21V 21/14* (2006.01)

(52) U.S. Cl. ..... 362/287; 362/365; 362/371; 362/372; 362/427

(58) Field of Classification Search ..... 362/427, 362/287, 285, 418, 368, 372, 365, 371
See application file for complete search history.

(56) References Cited

U.S. PATENT DOCUMENTS

| | | | |
|---|---|---|---|
| 394,680 | A | 10/1888 | Dawes |
| 393,126 | A | 11/1888 | Smart |
| 684,264 | A | 10/1901 | Kemmerer |
| 866,473 | A | 9/1907 | Keefe et al. |
| 1,127,527 | A | 2/1915 | Schoen |
| 1,137,906 | A | 5/1915 | Rosenberg |
| 1,501,524 | A | 7/1924 | Cousins |
| 1,631,488 | A | 6/1927 | Jones |
| 1,662,568 | A | 3/1928 | Foell |
| 1,704,626 | A | 3/1929 | Nero |
| 2,518,936 | A | 8/1950 | Roberts |
| 2,554,258 | A | 5/1951 | Lindquist |
| 2,647,202 | A | 7/1953 | Elmer |
| 2,716,185 | A | 8/1955 | Burliuk et al. |
| 2,739,226 | A | 3/1956 | Rex |
| 2,753,445 | A | 7/1956 | Thomas et al. |
| 2,757,818 | A | 8/1956 | Chanberlain |
| 2,762,598 | A | 9/1956 | Runge |
| 2,802,933 | A | 8/1957 | Broadwin |
| 2,842,281 | A | 7/1958 | Chisholm |
| 2,922,030 | A | 1/1960 | Bobrick |
| 2,937,841 | A | 5/1960 | Bodian |
| 2,965,348 | A | 12/1960 | Gerstel et al. |
| 3,057,993 | A | 10/1962 | Gellert |
| 3,082,023 | A | 3/1963 | Rudolph et al. |
| 3,168,252 | A | 2/1965 | Cagernoch |
| 3,182,187 | A | 5/1965 | Gellert |
| 3,313,931 | A | 4/1967 | Klugman |
| 3,381,123 | A | 4/1968 | Docimo |
| 3,420,995 | A | 1/1969 | Dunckel |
| 3,512,743 | A | 5/1970 | Lipscomb |
| 3,518,420 | A | 6/1970 | Kripp |
| 3,609,346 | A | 9/1971 | Lund et al. |
| 3,683,173 | A | 8/1972 | Guth, Jr. |
| 3,697,742 | A | 10/1972 | Bobrick |
| 3,700,885 | A | 10/1972 | Bobrick |
| 3,749,873 | A | 7/1973 | Harper et al. |
| 3,778,609 | A | 12/1973 | Ligerman |
| 3,872,296 | A | 3/1975 | Cohen et al. |
| 4,039,822 | A | 8/1977 | Chan et al. |
| 4,086,480 | A | 4/1978 | Lahm |

(Continued)

*Primary Examiner*—Thomas M Sember
(74) *Attorney, Agent, or Firm*—James E. Cole; Middleton Reutlinger

(57) ABSTRACT

An adjustment mechanism for a recessed light fixture comprises a housing, a first pivoting mechanism connected to the housing, a slotted pivot member connected to the first pivoting mechanism, an articulating lamp support movably connected to the slotted pivot member for translation and pivoting of the articulating lamp support, the slotted pivot member having two non-parallel slots for moving the articulating lamp support about a variable pivot point.

20 Claims, 8 Drawing Sheets

U.S. PATENT DOCUMENTS 4,142,227 A 2/1979 Aikens
4,232,361 A 11/1980 Kelsall
4,250,540 A 2/1981 Kristofek
4,274,615 A 6/1981 Chan et al.
4,293,895 A 10/1981 Kristofek
4,336,575 A 6/1982 Gilman
4,408,262 A 10/1983 Kusmer
4,414,617 A 11/1983 Galindo
4,431,151 A 2/1984 Schonasky
4,459,648 A 7/1984 Ullman
4,471,416 A 9/1984 Druffel
4,473,873 A 9/1984 Quiogue
4,475,147 A 10/1984 Kristofek
4,510,559 A 4/1985 Kristofek
4,605,816 A 8/1986 Jorgensen et al.
4,623,956 A 11/1986 Conti
4,646,212 A 2/1987 Florence
4,729,080 A 3/1988 Fremont et al.
4,733,339 A 3/1988 Kelsall
4,745,533 A 5/1988 Smerz
4,751,624 A 6/1988 Russo et al.
4,751,627 A 6/1988 Usher
4,754,377 A 6/1988 Wenman
4,829,410 A 5/1989 Patel
4,887,196 A 12/1989 Brown et al.
5,045,985 A 9/1991 Russo et al.
5,068,772 A 11/1991 Shapiro et al.
5,122,944 A 6/1992 Webb
5,124,901 A 6/1992 Sojka et al.
5,130,914 A 7/1992 Bengochea
5,222,800 A 6/1993 Chan et al.
5,291,381 A 3/1994 Price
5,314,148 A 5/1994 Jones
5,317,493 A 5/1994 Muller et al.
5,373,431 A 12/1994 Hayman et al.
5,377,088 A 12/1994 Lecluze
5,452,193 A 9/1995 Hinnefeld et al.
5,457,617 A 10/1995 Chan et al.
5,538,214 A 7/1996 Sinila
5,556,188 A 9/1996 Poppenheimer
5,562,343 A 10/1996 Chan et al.
5,564,815 A 10/1996 Littman et al.
5,567,041 A 10/1996 Slocum
5,609,414 A 3/1997 Caluori
5,630,663 A 5/1997 Ling et al.
5,669,324 A 9/1997 Muir, III
5,672,004 A 9/1997 Schmidt, Jr.
5,738,436 A 4/1998 Cummings et al.
5,823,664 A 10/1998 Demshki, Jr. et al.
5,826,970 A 10/1998 Keller et al.
5,857,766 A 1/1999 Sieczkowski
5,941,625 A 8/1999 Morand
5,951,151 A 9/1999 Doubeck et al.
6,036,337 A * 3/2000 Belfer ..... 362/287
6,079,852 A 6/2000 Kamaya et al.
6,113,245 A 9/2000 Reinert, Sr.
6,132,245 A 10/2000 Wetz et al.
6,142,439 A 11/2000 Aramaki
6,145,798 A 11/2000 Janisse et al.
6,220,728 B1 4/2001 Andrus et al.
6,234,644 B1 5/2001 Kotovsky et al.
6,270,238 B1 8/2001 Mendelsohn et al.
6,343,873 B1 2/2002 Eberhard et al.
6,375,338 B1 4/2002 Cummings et al.
6,402,112 B1 * 6/2002 Thomas et al. ..... 248/317
6,431,723 B1 8/2002 Schubert et al.
6,505,960 B2 1/2003 Schubert et al.
7,118,254 B2 10/2006 Czech
7,234,674 B2 6/2007 Rippel et al.
2003/0007354 A1 * 1/2003 Schubert et al. ..... 362/285

* cited by examiner

RECESSED LUMINAIRE ADJUSTMENT MECHANISM

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention pertains to recessed light fixtures. More particularly, the present invention pertains to an adjustment mechanism for a recessed light fixture.

2. Description of the Related Art

Recessed lighting fixtures have become extremely popular for both residential and commercial uses. Although many fixtures do not provide light aiming capability, some manufacturers have included such functionality. Some recessed fixtures are adjustable to aim the output light by rotating the fixture about a vertical axis (pan), for example, extending through the lamp as well as pivoting the lamp about an axis perpendicular to the vertical axis (tilt). Thus, the lamp may be adjustable about two axes to aim the light output from the recessed luminaire. Such adjustability allows for use as a downlight, a wall-wash luminaire, or to aim the light output at a specific object. This aiming functionality increases the utility of the fixture.

One problem with movable recessed downlights is that of interference of the light with objects within the fixture. Specifically, when the light is moved from the upright downlight position, the interference is generally minimal. However, when the light is moved to some angular position, the internal components defining the fixture may interfere with the light path. This interference is due in part to the position of the lamp which is typically higher in the fixture and pivots about a single point. Also, interference may be due to the position of the light relative to the trim or reflector as well as the shape of the upper aperture of the reflector or trim.

It is preferable to minimize the interference of the light from the internal components of the recessed fixture while maintaining the adjustability of the recessed light fixture.

SUMMARY OF THE INVENTION

An adjustment mechanism for a recessed light fixture comprises a housing, a first pivoting mechanism connected to the housing, a slotted pivot member connected to the first pivoting mechanism, an articulating lamp support movably connected to the slotted pivot member for translation and pivoting of the articulating lamp support, the slotted pivot member having two non-parallel slots for moving the articulating lamp support about a variable pivot point. The non-parallel slots are non-concentric and substantially curved. The variable pivot point is defined by a plurality of pivot points which vary with the positioning of the articulating lamp support. The adjustment mechanism further comprises a control arm pivotally connected to the slotted pivot member. The adjustment mechanism further comprises a pinion gear connected to the control arm. The adjustment mechanism further comprises a transmission gear engaging the pinion gear. The transmission gear comprises a worm screw. The adjustment mechanism further comprises a fastener extending from the control arm through one of the two non-parallel slots and to the articulating lamp support. The first pivoting mechanism comprises a stationary race connected to the housing. The adjustment mechanism further comprises a pivotable race pivotable relative to the stationary race. The pivotable race has an opening defining a light path. The adjustment mechanism further comprises a brake inhibiting motion of the first pivoting mechanism. One of the two non-parallel slots guides movement of a control arm and the two non-parallel slots guide movement of the articulating lamp support.

An adjustment mechanism comprises an articulating lamp support, a slotted pivot member, the articulating lamp support movable along non-parallel slots within the slotted member, a control arm moving the articulating lamp support, the slotted pivot member guiding movement of the control arm and the articulating lamp support, the slotted pivot member pivotable about a vertical axis for panning the articulating lamp support. The articulating lamp support is connected to the control arm and the slotted pivot member. The control arm further comprises a pinion gear. The pinion engages a worm screw. The lamp support translates and pivots about a variable pivot point.

A recessed luminaire adjustment mechanism comprises a lamp assembly connected to a first pivoting mechanism and a second pivoting mechanism, the first pivoting mechanism providing pivotal motion of the lamp assembly about a vertical axis, the second pivoting mechanism providing translation of the lamp assembly and pivotal motion of the lamp assembly about a variable pivot point, one of the first pivoting mechanism and the second pivoting mechanism connected to a trim housing. The recessed luminaire adjustment mechanism further comprises a pivot member having non-parallel slots. The recessed luminaire adjustment mechanism further comprises a first fastener connecting the lamp assembly and the pivot member. The recessed luminaire adjustment mechanism further comprises a second fastener connecting the lamp assembly and the second pivoting member.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
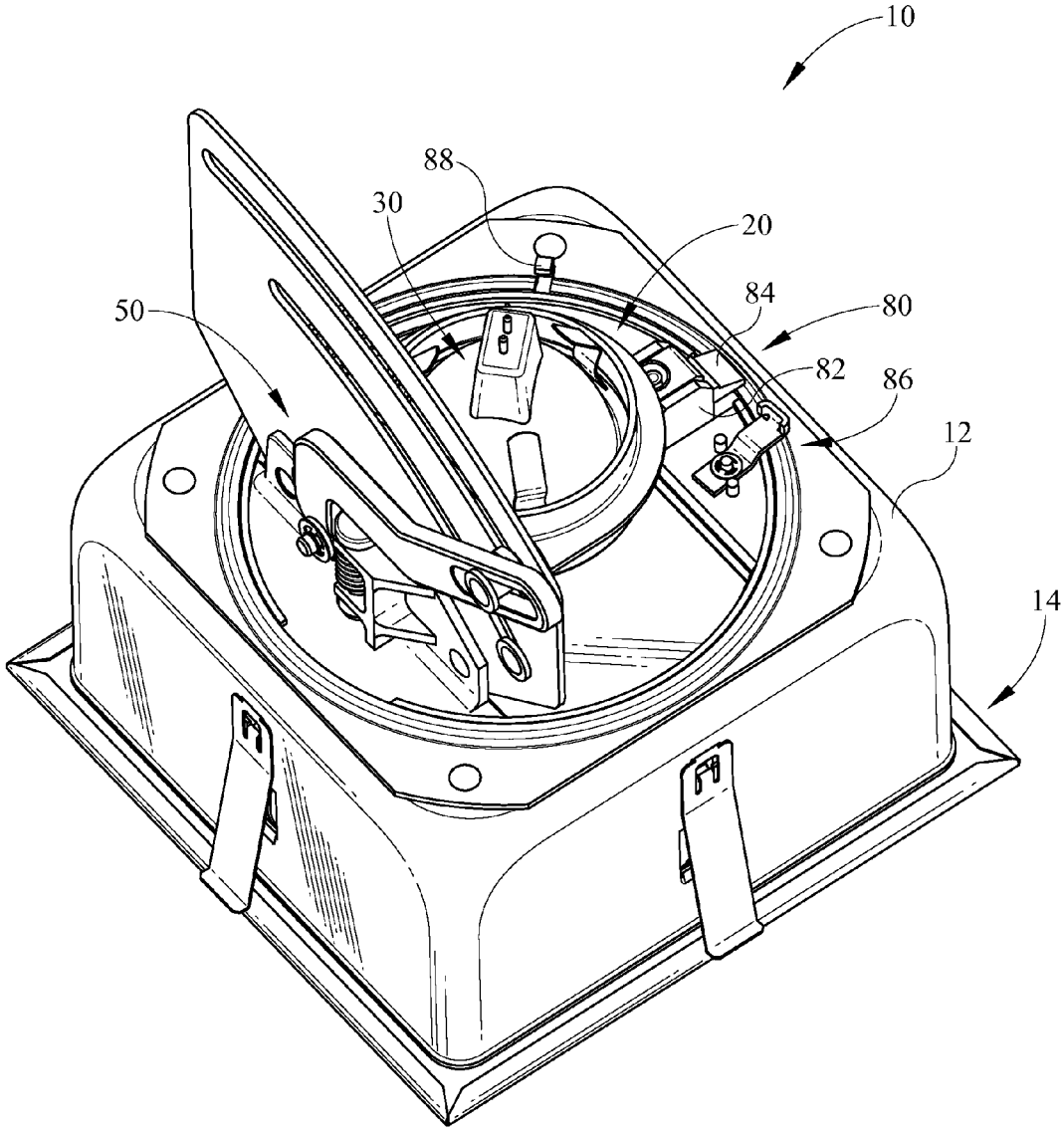
FIG. 1 is a perspective view of an adjustable recessed light fixture.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1-8 various aspects of an adjustable recessed light fixture. The at least one embodiment of the adjustable recessed light fixture herein allows for adjustment of a recessed light fixture to provide various light angles while inhibiting interference with the internal components of the fixture which might otherwise cut-off the light throw from the fixture. As a result light output is maximized while still providing the adjustability which is desirable of recessed luminaires. Referring initially to FIG. 1, a top perspective view of a recessed fixture subassembly 10 is depicted. The recessed fixture subassembly 10 comprises a housing 12 which is generally square shaped and further comprises a trim 14 disposed within the housing 12 and extending from the lower peripheral edge of the housing 12. The trim has a square shaped flange but such is merely exemplary as other shapes may be utilized. The upper portion of housing 12 comprises an opening which is substantially circular in shape. The lower portion of the housing 12 comprises a substantially square shaped opening to receive the exemplary trim 14. Although the housing 12 is depicted as being square in shape, the embodiments of the present invention may also be utilized with a housing having a cylindrical or can shape, or other shape, as will be understood by one of ordinary skill in the art. Likewise, although the exemplary square trim 14 is depicted, the trim 14 may be various alternative shapes such as circular or other polygonal shape. Connected to the upper portion of the housing 12 is a first pivot mechanism 20 which allows pivotal motion of a lamp assembly about a vertical axis relative to the housing 12. Disposed above the first pivot mechanism 20 is a lamp assembly 30. The first pivot mechanism 20 allows for rotational movement of the lamp assembly 30 about a vertical axis which is typically referred to as pan movement. A second pivot mechanism 50 is depicted adjacent the first pivot mechanism 20 and adjacent the lamp assembly 30. The second pivot mechanism 50 allows translational and rotational pivoting of the lamp assembly 30 from the downwardly directed position shown in FIG. 1 to a position at about 45 degrees from a vertical axis. The structure of the fixture 10 also keeps the lamp assembly 30 low, closer to the trim 14, which inhibits interference between the lamp output and components of the fixture 10.

Figure 2:
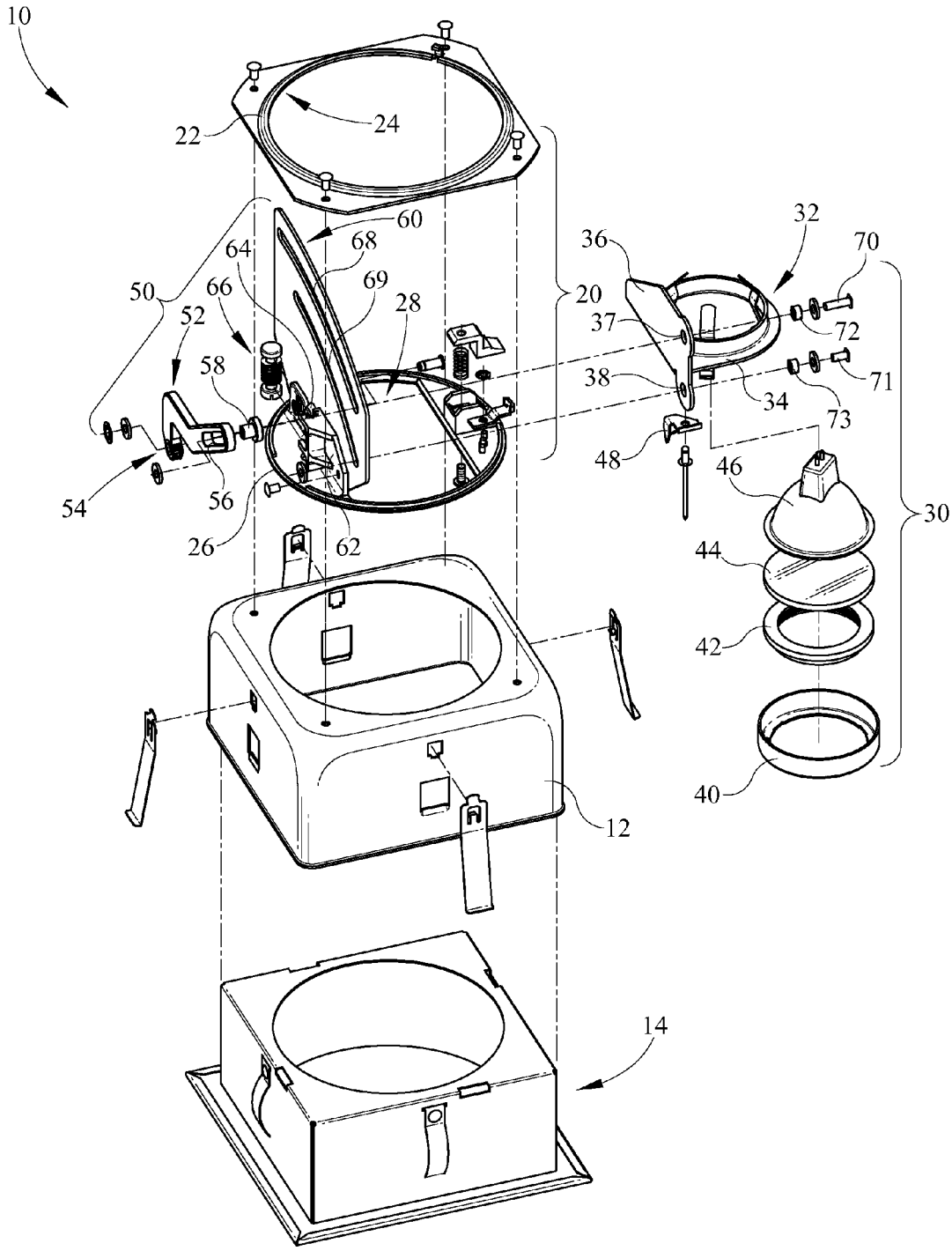
FIG. 2 is an exploded perspective view of the adjustable recessed light fixture of FIG. 1.

Referring now to FIG. 2, an exploded perspective view of the recessed fixture 10 is depicted. The lamp assembly 30 comprises an articulating lamp support 32. The lamp support 32 moves with the first pivot mechanism 20 and the second pivot mechanism 50. The lamp support 32 comprises a circular shaped collar 34 and a plate 36 connected to the collar 34. The plate 36 comprises an upper aperture 37 and a lower aperture 38 which correspond to slots 68, 69, respectively, positioned on a pivot member 60, described further herein. Disposed beneath the lamp support 32 are a holder ring 40 which holds a lamp 46 and may house a baffle 42, a lens 44. One skilled in the art will realize that the holder 40 may have alternative shapes and may have provision to hold other light controlling devices. The exemplary lamp of the present invention may be an MR16 but one skilled in the art will realize that alternative lamps or light sources may be used with use of an adapter. The assembly of the holder ring 40, baffle 42, lens 44, lamp 46 is slidably positioned upwardly through the collar 34 of the articulating lamp support 32 so that springs extending from the holder ring 40 engage the collar 34 and so that the ring, baffle, lens and lamp are seated within the collar 34 to define the lamp assembly 30. The assembly 30 may further comprise an angle indicator 48 which is connected to the lamp support 32 and indicates an angle of the lamp assembly 30 relative to the pivot plate 60, described further herein.

Referring to FIGS. 1 and 2, to the left of the lamp assembly 30, the first pivot mechanism 20 is depicted for positioning on the upper surface of the housing 12. The pivot mechanism 20 comprises an outer race 22 which is connected to the housing 12. The upper surface of the housing 12 comprises an opening and the outer race 22 also comprises a raised lip 24, defining an opening, which is disposed over the opening in the upper surface of housing 12. The opening in the outer race 22 is defined by a lip which provides a space between the outer race 22 and the trim housing 12. An inner race 26 is seated between the outer race 22, specifically the lip 24, and the trim housing 12. The inner race 26 has a diameter defined by a peripheral edge which is larger than the diameter of the opening in housing 12 or the inner diameter defined by lip 24. Accordingly, the inner race is captured therebetween for rotation relative to the housing 12 and outer race 22. The lip 24 and housing 12 capture the peripheral edge of the inner race 26 so that the inner race 26 cannot be removed from the assembly without first removing the outer race 22. The inner race 26 is substantially circular in shape with a central opening providing a light path for the lamp assembly 30. The first pivoting mechanism 20 allows for motion of the inner race or casting 26 about a vertical axis.

Disposed on an upper surface of the inner race 26 is a second pivoting mechanism 50 which provides tilting and translation of the lamp assembly 30. The second pivoting mechanism 50 comprises a control arm 52 which is pivotally connected to a pivot member 60. The control arm 52 comprises a pinion gear 54 at a first end and a control arm slot 56 at a second end distal from the pinion gear 54. The control arm 52 is bent to extend from the pivot location 64 of the pivot member 60 to ends of the slots 68, 69 within the pivot member 60 in the depicted position. A bushing 58 is disposed within the slot 56 and moves through slot 56 during motion of the control arm 52. The bushing 58 also acts as a spacer between the control arm 52 and the pivot member 60. The pivot member 60 is connected to the inner race 26 at a gusset 62. Extending through the pivot member 60 is an aperture 64 defining a pivot location, through which a rivet passes allowing pivoting of the control arm 52 relative to the pivot member 60. Positioned on the gusset 62 is a transmission gear 66. The exemplary transmission gear 66 is a worm screw which engages the pinion 54 of the control arm 52. A hole or aperture is formed in an upper surface of the inner race 26 so that a screwdriver or other tool may be utilized to extend upwardly through the trim housing 12 and rotate the transmission gear 66. Accordingly, the control arm 52 pivots about the aperture 64 of the pivot member 60 through a preselected angular range of motion.

The pivot member 60 comprises a first upper slot 68 and a second non-parallel slot 69. One skilled in the art will realize that the pivot member 60 may have alternative shapes than that shown and that the slots have various orientations to allow other paths of lamp support 32 travel. Extending through the upper slot 68, and the aperture 37 of the plate 36 is a first rivet 70. Similarly, rivet 71 extends through plate aperture 38 and the lower slot 69. A bushing 72 extends over the rivet 70 and is located within the slot 68. Likewise, a second bushing 73 is positioned over the rivet 71 and within the second slot 69. The rivets 70, 71 extend through the pivot member 60 so that the first rivet 70 passes through the bushing or spacer 58 and the control arm 52. Likewise, the rivet 71 passes through the pivot member 60 to receive a washer on the opposite side of the pivot member 60. Washers are utilized on both rivets 70, 71 to retain the bushings 72, 73 in position within the slots 68, 69 as depicted in the assembly. The bushing 58 functions as a washer on the opposite side of the pivot member from the articulating lamp support 32. According to such construction, movement generated by the control arm 52 causes movement of the articulating lamp support 32 due to the connection by rivet 70 and controlled motion of bushings 72, 73 through the non-parallel slots. A washer is utilized to retain the assembly together on the opposite side of the control arm 52. Meanwhile, the connection between the rivet 71 and pivot member 60 further guides the articulating lamp support 32 during the movement caused by the control arm 52.

Figure 3:
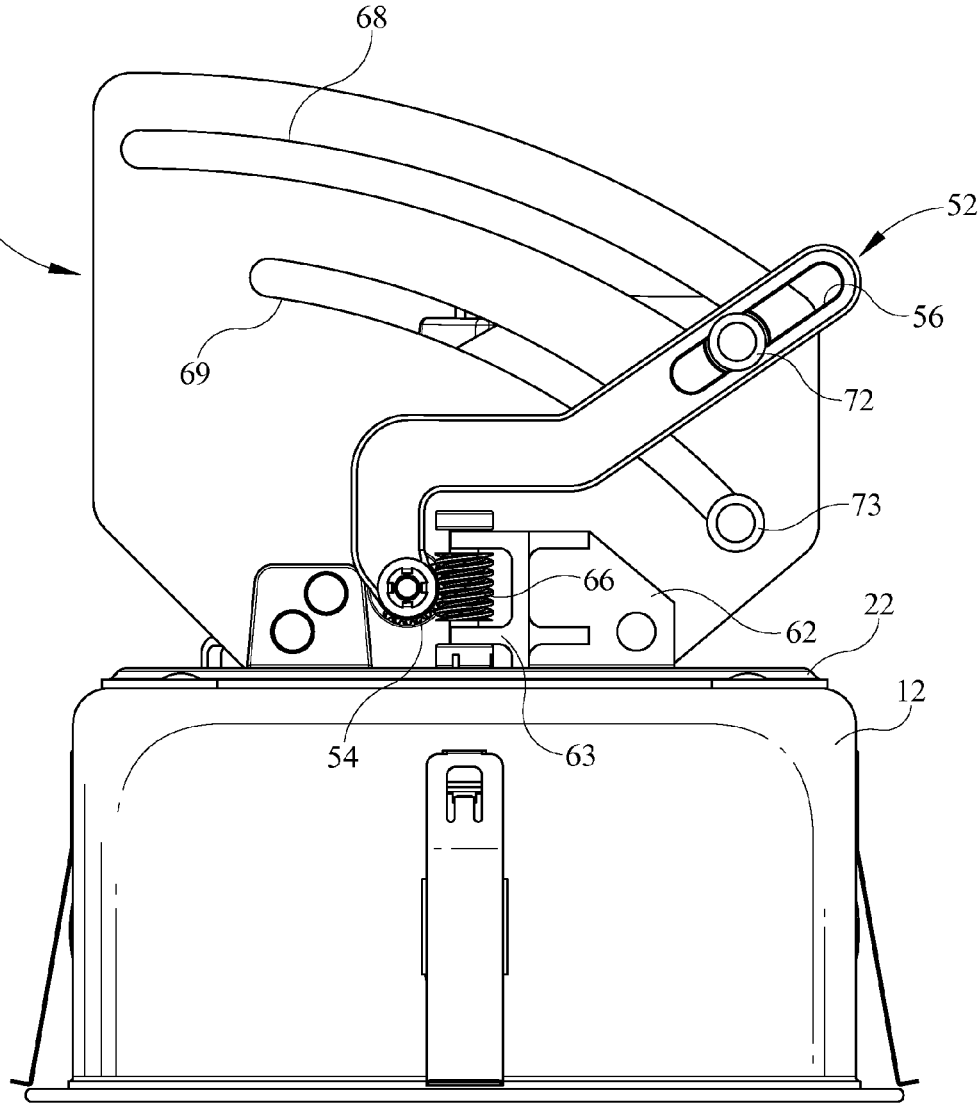
FIG. 3 is a side view of the adjustable recessed light fixture of FIG. 1 in a first position.
Figure 4:
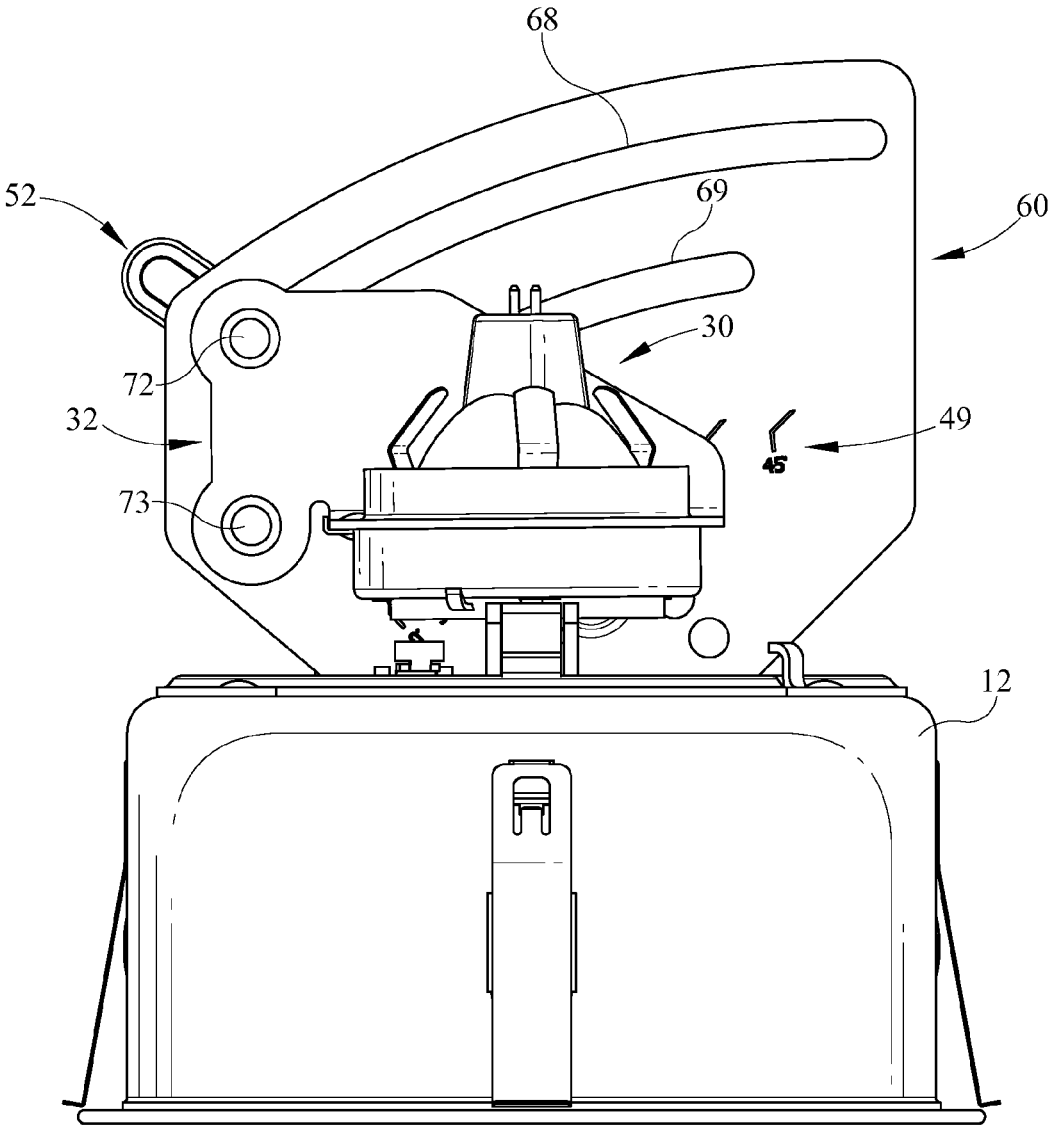
FIG. 4 is a side view opposite that of FIG. 3 of the adjustable recessed light fixture of FIG. 1 in the first position.

Referring now to FIGS. 3 and 4, the recessed lighting fixture 10 is depicted in opposed side views with the lamp assembly 30 is a first down light position. In FIG. 3, the side of the pivot member 60 depicted comprises the control arm 52, which is depicted at an extreme position at the ends of the non-parallel slots 68, 69. The gusset 62 is depicted comprising a base 63 wherein the transmission gear or worm screw 66 is rotatably positioned. The worm screw 66 is mateably engaged with the pinion 54 so that the bushings 72, 73, generally represented by washers and fasteners, are at their farthest right-hand position within the slots 68, 69. As shown in FIG. 4, from the opposite side of the pivot member 60, the lamp support 32 is depicted in its furthest left-hand position (same as FIG. 5 3) within the slots 68, 69. Accordingly, the lamp assembly 30 is substantially vertically positioned providing down light through the trim housing 12. Additionally, the apertures 37, 38 of the lamp support 32 are shown in a substantially vertical alignment adjacent ends of the slots 68, 69. Also depicted on the pivot member 60 are a plurality of lamp angle indicators 49 which utilize the indicator 48 to visually depict the angle of the lamp assembly 30 with respect to the vertical axis. When developing the non-parallel path of slots 68, 69, the position of lamp support 32 in FIGS. 3 and 4 was utilized for reference. The upper bushing 72 moves with the motion of control arm 52 through a path determined by slot 68. The bushing 73 moves through a path which is ascertained by the position of bushing 72 within slot 68 and the desired angle of the lamp assembly at a given position of control arm 52 movement.

Figure 5:
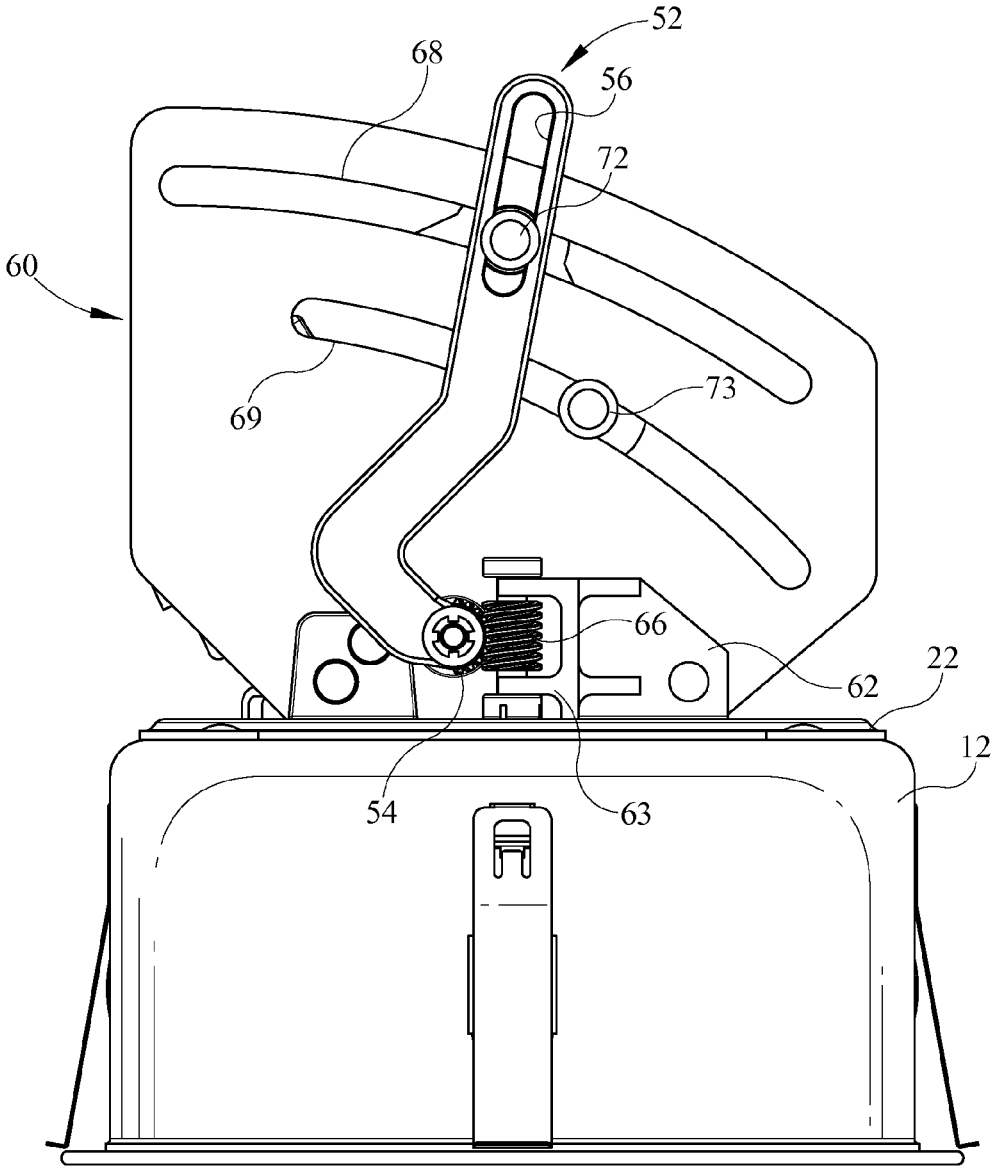
FIG. 5 is a side view of the adjustable recessed light fixture of FIG. 1 in a second position.
Figure 6:
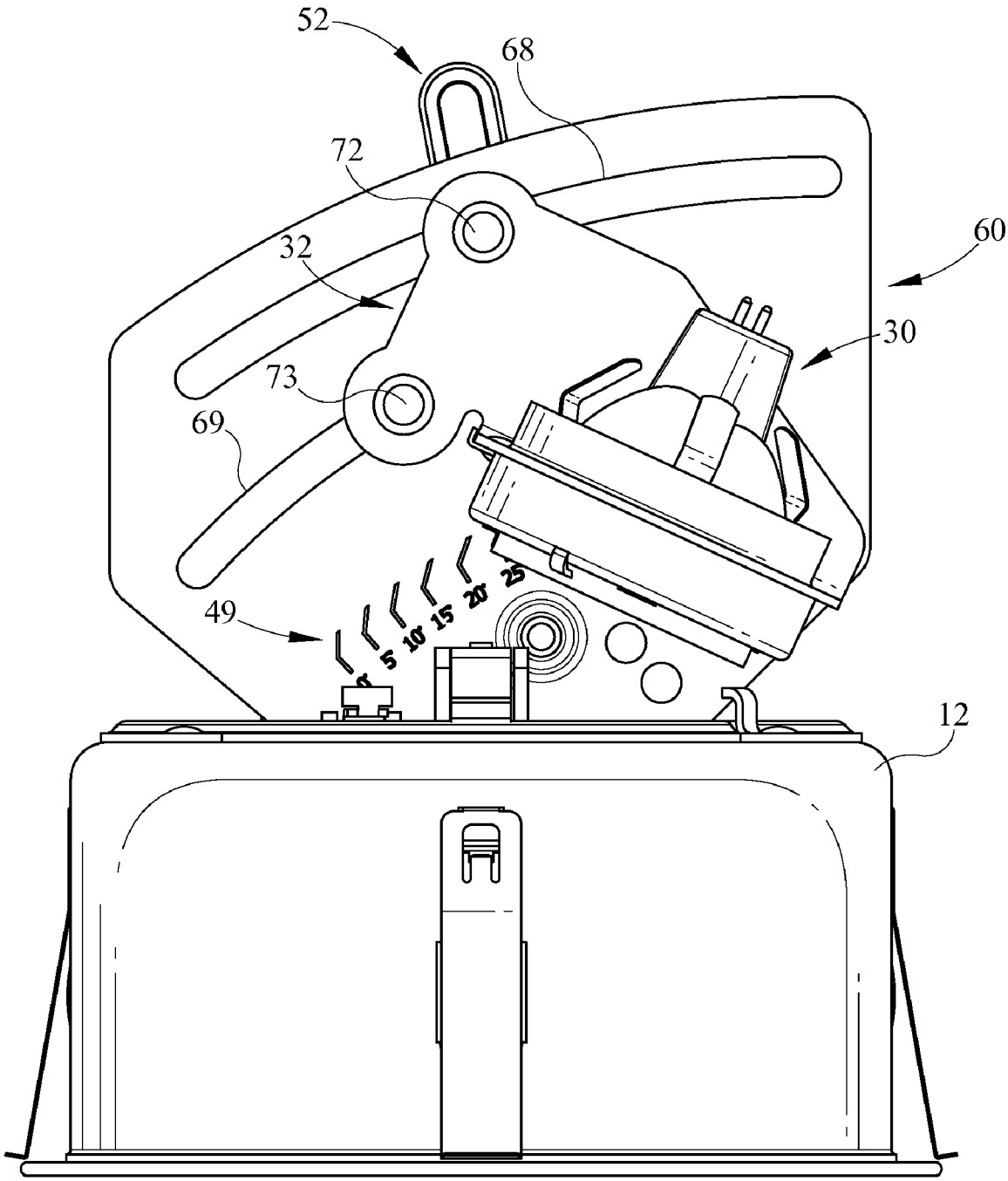
FIG. 6 is a side view opposite that of FIG. 5 of the adjustable recessed light fixture of FIG. 1 in the second position.

Referring now to FIGS. 5 and 6, the recessed lighting fixture 10 is depicted with the lamp assembly 30 in a second position moved substantially midway between the 0 and 45 degree lamp angle indicator 49. With reference first to FIG. 5, the control arm 52 is moved from its position at the right most end of slots 68, 69 to a position substantially centrally positioned within those slots. Due to rotation of the worm screw 66, the pinion 54 and control arm 52 have rotated in a substantially counter-clockwise direction. The upper bushing 72, generally indicated by a washer, is moved within the slot 68, a horizontal distance which is greater than the movement of the bushing 73 (generally represented by the washer) through slot 69. This causes both horizontal translation and rotation of the lamp assembly 30 as shown in FIG. 6. The lamp support 32 is rotated in a counter-clockwise direction from the position shown in FIG. 4. The rotation of the lamp assembly 30 is not about a single point but is instead about multiple points or a variable pivot point. As a result of the movement of control arm 52, the lamp assembly 30 is translated and rotated to a position at about 25 degrees from a vertical axis.

Figure 7:
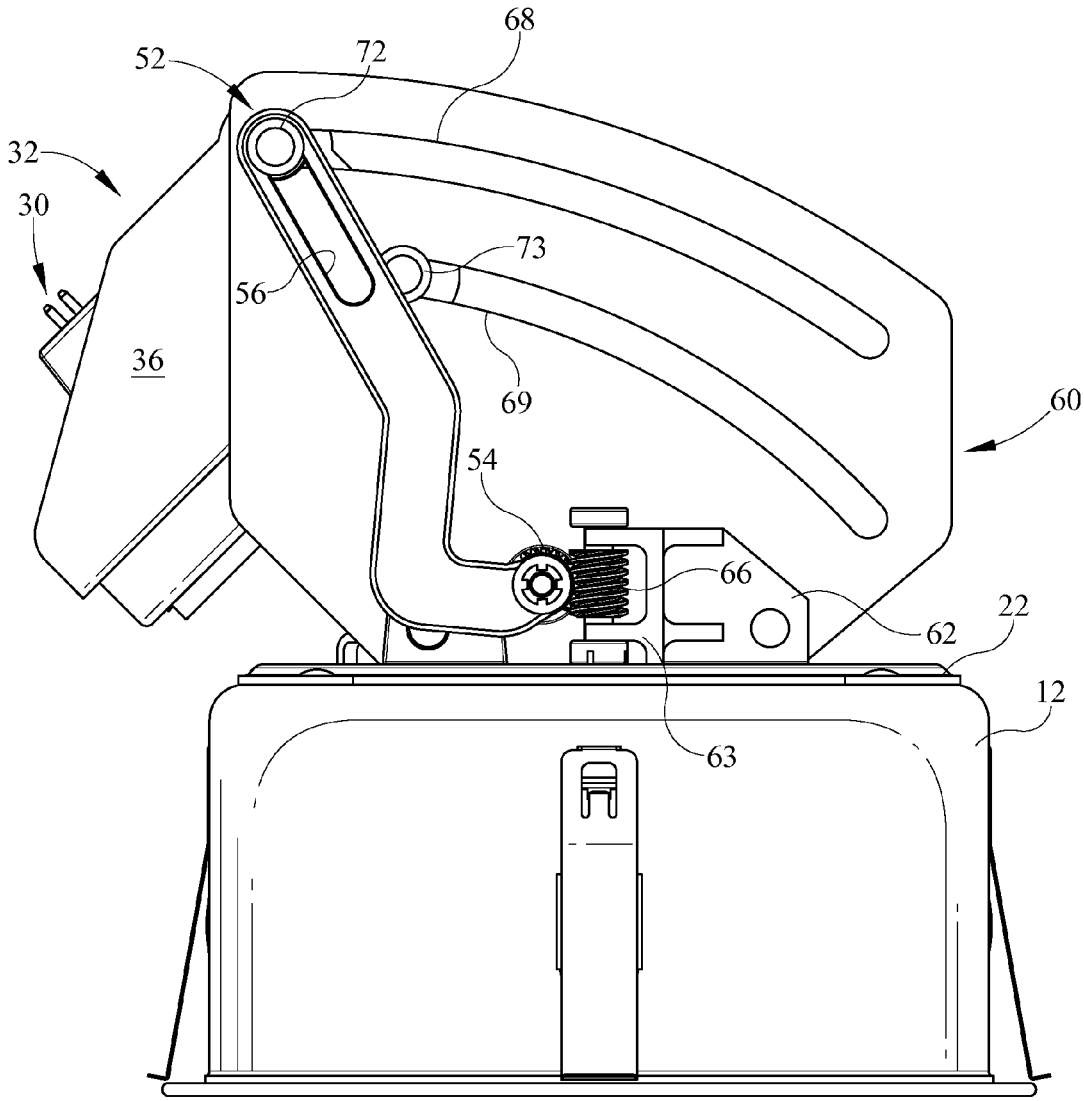
FIG. 7 is a side view of the adjustable recessed light fixture of FIG. 1 in a third position; and, FIG. 8 is a side view opposite that of FIG. 7 of the adjustable recessed light fixture of FIG. 1 in the third position.
Figure 8:
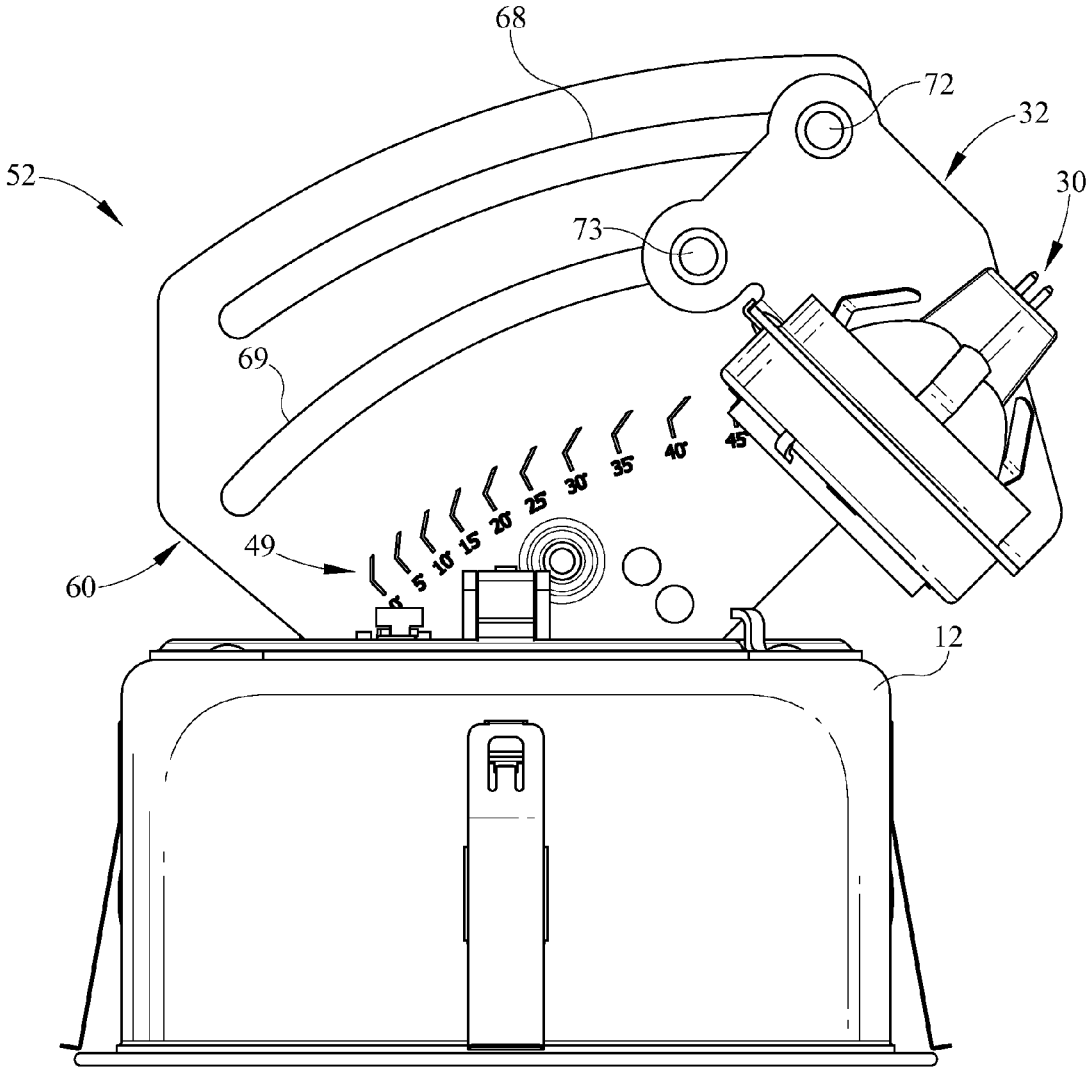

Referring now to FIGS. 7 and 8, the recessed light fixture 10 is again depicted in an extreme position, opposite that shown in FIGS. 3 and 4, within the slots 68, 69. With reference first to FIG. 7, the control arm 52 is rotated, due to rotation of the worm gear 66 and engagement of the pinion 54 to an uppermost position. As a result, the bushings 72, 73 are slidably positioned in the upper left most ends of the slots 68, 69 of the pivot member 60. As a result of the positioning of the control arm 52 relative to the pivot member 60, the plate 36 of the articulating lamp support 32 is moved from behind the pivot member and visible with the lamp assembly 30 positioned therein. As shown in FIG. 8, the lamp assembly 30 is positioned at about 45 degrees from the vertical axis and the upper bushing 72 and lower bushing 73 are translated from the positions shown in FIGS. 5 and 6.

Referring to FIGS. 4, 6, 8 in sequence translational and rotational movement of the lamp assembly 30 is depicted. The translation of lamp assembly 30 is substantially horizontal motion moving through the arcuate non-parallel slots 68, 69. The lamp assembly 30 also rotates during the horizontal translation. However, the rotation of lamp assembly is not limited to a single pivot point. Therefore, the lamp has a variable pivot point or multiple pivot points. Additionally, the indicators 49 depict that movement horizontally increases in order to rotate the assembly 30 five degrees. This is depicted by the increased spacing of the indicators 49 as the lamp assembly 30 moves toward the 45 degree indicator. Since the slots 68, 69 are non-parallel, the movement of bushings 72, 73 in non-parallel fashion causes rotation of the lamp support 32 and therefore the lamp assembly 30.

Referring again to FIG. 1, the first pivot mechanism 20 further comprises a brake assembly 80. The brake assembly 80 includes a brake seat 82 extending from an upper surface of the inner race 26. The brake seat 82 provides a locator for the brake 84 which extends from the inner race 26 to the outer race 22 so as to frictionally engage the lip 24 and inhibit rotation of the inner race 26 relative to the outer race 22. A fastener aperture is located on the inner race 26 so that a person may access a screw to tighten the brake 84. The upper surface of the inner race 26 further comprises a pivoting stop mechanism 86 which moves relative to the upper surface of the inner race 26. The pivoting member 86 engages a stop on the outer race 22 to limit the rotation of the inner race 26 relative to the outer race 22 to about 360 degrees. The pivoting motion of member 86 allows for an additional about 5 degrees of motion for a total of about 365 degrees of rotation. This inhibits undue twisting of the lamp wires (not shown) which may result in failure of the recessed fixture after installation.

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An adjustment mechanism for a recessed light fixture, comprising:

a housing;

a first pivoting mechanism connected to said housing;

a slotted pivot member connected to said first pivoting mechanism;

an articulating lamp support movably connected to said slotted pivot member for translation and pivoting of said articulating lamp support;

said slotted pivot member having two non-parallel slots for moving said articulating lamp support about a variable pivot point;

a control arm pivotally connected to said slotted pivot member; and, a transmission connected to said control arm.

2. The adjustment mechanism of claim 1, said non-parallel slots being non-concentric and substantially curved.

3. The adjustment mechanism of claim 1, said variable pivot point being defined by a plurality of pivot points which vary with the positioning of said articulating lamp support.

4. The adjustment mechanism of claim 1, said transmission further comprising a pinion gear connected to said control arm.

5. The adjustment mechanism of claim 4 further comprising a transmission gear engaging said pinion gear.

6. The adjustment mechanism of claim 5, said transmission gear comprising a worm screw.

7. The adjustment mechanism of claim 1 further comprising a fastener extending from said control arm through one of said two non-parallel slots and to said articulating lamp support.

8. The adjustment mechanism of claim 1, said first pivoting mechanism comprising a stationary race connected to said housing.

9. The adjustment mechanism of claim 8 further comprising a pivotable race pivotable relative to said stationary race.

10. The adjustment mechanism of claim 9, said pivotable race having an opening defining a light path.

11. The adjustment mechanism of claim 9 further comprising a brake inhibiting motion of said first pivoting mechanism.

12. The adjustment mechanism of claim 1 wherein one of said two non-parallel slots guides movement of a control arm and said two non-parallel slots guide movement of said articulating lamp support.

13. An adjustment mechanism, comprising:

an articulating lamp support;

a slotted pivot member, said articulating lamp support movable along non-parallel slots within said slotted member;

a control arm moving said articulating lamp support, said slotted pivot member guiding movement of said control arm and said articulating lamp support;

said slotted pivot member pivotable about a vertical axis for panning said articulating lamp support;

said control arm further comprising a transmission for moving said articulating lamp support.

14. The adjustment mechanism of claim 13, said articulating lamp support connected to said control arm and said slotted pivot member.

15. The adjustment mechanism of claim 13, said transmission further comprising a pinion gear.

16. The adjustment mechanism of claim 15, said pinion engaging a worm screw.

17. The adjustment mechanism of claim 13, said lamp support translating and pivoting about a variable pivot point.

18. A recessed luminaire adjustment mechanism, comprising:

a lamp assembly connected to a first pivoting mechanism and a second pivoting mechanism;

said first pivoting mechanism providing pivotal motion of said lamp assembly about a vertical axis;

said second pivoting mechanism providing translation of said lamp assembly and pivotal motion of said lamp assembly about a variable pivot point;

one of said first pivoting mechanism and said second pivoting mechanism connected to a trim housing;

said one of said first pivoting mechanism and second pivoting mechanism having:

a slotted pivot member having two non-parallel slots for moving said lamp assembly about said variable pivot point;

a control arm pivotally connected to said slotted pivot member for moving said lamp assembly; and, a transmission connected to said control arm.

19. The recessed luminaire adjustment mechanism of claim 18 further comprising a first fastener connecting said lamp assembly and said pivot member.

20. The recessed luminaire adjustment mechanism of claim 19 further comprising a second fastener connecting said lamp assembly and said second pivoting member.

* * * * *